US009273922B2

(12) United States Patent
Hudkins

(10) Patent No.: US 9,273,922 B2
(45) Date of Patent: Mar. 1, 2016

(54) CROSSBOW WITH ROTATING LIMB POCKETS

(71) Applicant: Jason M. Hudkins, Rochester, IN (US)

(72) Inventor: Jason M. Hudkins, Rochester, IN (US)

( * ) Notice: Subject to any disclaimer, the term of this patent is extended or adjusted under 35 U.S.C. 154(b) by 105 days.

(21) Appl. No.: 13/890,699

(22) Filed: May 9, 2013

(65) Prior Publication Data

US 2013/0312724 A1 Nov. 28, 2013

Related U.S. Application Data

(60) Provisional application No. 61/650,716, filed on May 23, 2012.

(51) Int. Cl.
*F41B 5/12* (2006.01)

(52) U.S. Cl.
CPC ..... *F41B 5/123* (2013.01)

(58) Field of Classification Search
CPC ..... F41B 5/123
USPC ..... 124/25
See application file for complete search history.

(56) References Cited

U.S. PATENT DOCUMENTS

| | | | | |
|---|---|---|---|---|
| 3,028,851 | A * | 4/1962 | Drake | F41B 5/12 124/16 |
| 3,783,852 | A * | 1/1974 | Shepherd | 124/22 |
| 6,024,076 | A * | 2/2000 | Laborde | F41B 5/0026 124/23.1 |
| 7,568,372 | B1 * | 8/2009 | Patton | A62B 3/005 72/453.15 |
| 2008/0127956 | A1 * | 6/2008 | Bednar et al. | 124/25 |
| 2014/0261360 | A1 * | 9/2014 | Pulkrabek | F41B 5/1469 124/35.2 |

* cited by examiner

*Primary Examiner* — Gene Kim
*Assistant Examiner* — Jeffrey Vanderveen
(74) *Attorney, Agent, or Firm* — Gerald E. Helget; Nelson R. Capes; Briggs and Morgan, P.A.

(57) ABSTRACT

A crossbow with rotating limb pockets has a rifle-like frame with forward, outward limb arch supports which support pivot pins at their distal ends. Rotating limb pockets are pivotally and rearwardly secured to the arch support pivot pins. Limbs with distal cams supporting cables and bow string are suitably fixed to the limb pockets such as by screws. Forwardly the limb pockets are pivotally secured to links which are pivotally joined to a forward and rearward moving actuator controlled by a crank mechanism. Extending the actuator rotates the limb pockets outwardly and the limb cams inwardly to a low poundage state for easy cocking of the string and loading a bolt or arrow. Retracting the actuator rotates the limb pockets inwardly and the limb cams outwardly to a high poundage state ready for shooting.

6 Claims, 7 Drawing Sheets

CROSSBOW WITH ROTATING LIMB POCKETS

BACKGROUND OF THE INVENTION

The present invention relates to high poundage crossbows, and more particularly to a high poundage crossbow that is easily cocked.

Crossbows have been around for centuries going back to middle ages. In most cases they replaced archery bows when the former archers had muscular or skeletal injuries which prohibited them from pulling and holding the bow back to fully loaded position ready for release of an arrow. Also because crossbows are easily aimed, a novice or an elderly person may accurately shoot a crossbow without any previous archery experience.

Today crossbows are of a much higher poundage than most bows and are extremely accurate. FIG. 1 shows a modern crossbow 10 which may have a poundage of 180-200 pounds. The crossbow 10 has a rifle-like frame 12 with transverse limbs 14. The limbs 14 are fastened to the frame with permanent, fixed limb pockets 16. Cams 18 extend outwardly from the limbs 14 around which is wrapped the cable or bow string 20. At the front of the crossbow extending forwardly is a stirrup 22 for placing one's foot therein for cocking the crossbow string 20 with hands and fingers, after which an arrow or bolt 24 is loaded into position for shooting. Thereafter, the crossbow 10 shoots much like a rifle.

FIG. 2 shows a modern crossbow 26 with reverse limbs which also may have a poundage of 180-200 pounds. The crossbow 26 has a rifle-like frame 12 with transverse reversed limbs 14. The limbs 14 are fastened to the frame with permanent, fixed limb pockets 16. Cams 18 extend outwardly from the limbs 14 around which is wrapped the cable or bow string 20. At the front of the crossbow extending forwardly is a stirrup 22 for placing one's foot therein for cocking the crossbow string 20, after which an arrow or bolt 24 is loaded into position for shooting. Thereafter, the crossbow 26 shoots much like a rifle.

SUMMARY OF THE INVENTION

A crossbow with rotating limb pockets has a rifle-like frame with forward, outward limb arch supports which support pivot pins at their distal ends. Rotating limb pockets are pivotally and rearwardly secured to the arch support pivot pins. Limbs with distal cams supporting cables and bow string are suitably fixed to the limb pockets such as by screws. Forwardly the limb pockets are pivotally secured to links which are pivotally joined to a forward and rearward moving actuator controlled by a crank mechanism. Extending the actuator rotates the limb pockets outwardly and the limb cams inwardly to a low poundage state for easy cocking of the string and loading a bolt or arrow. Retracting the actuator rotates the limb pockets inwardly and the limb cams outwardly to a high poundage state ready for shooting.

A principal object and advantage of the present invention is the elimination of the stirrup and rotating inwardly the limbs and cams rendering the crossbow compact for transportation and carrying in the woods or field.

Another object and advantage of the present invention is the elimination of the stirrup allows for the crossbow to have a longer power stroke.

Another object and advantage of the present invention is the creation of a much higher crossbow poundage rating well over 200 pounds.

Another object and advantage of the present invention is the creation of a much higher crossbow poundage rating well over 200 pounds that is easily cocked by the operator while at a low poundage of approximately 20 pounds.

Another object and advantage of the present invention is the creation of a much higher crossbow poundage rating well over 200 pounds that is easily cocked by the operator while at a low poundage of approximately 20 pounds and is cranked or pumped to high poundage ratings by a simple crank connected to a rack and pinion, screw jack, hydraulic winch or mechanism or compressed gas.

Another object and advantage of the present invention is the creation of a much higher crossbow poundage rating well over 200 pounds that is easily uncocked by the operator while at a high poundage to low poundage by reversal of the cranking or pumping for easy safe uncocking by hand and removal of the arrow or bolt.

DETAILED DRAWINGS

DETAILED SPECIFICATION

Figure 1:
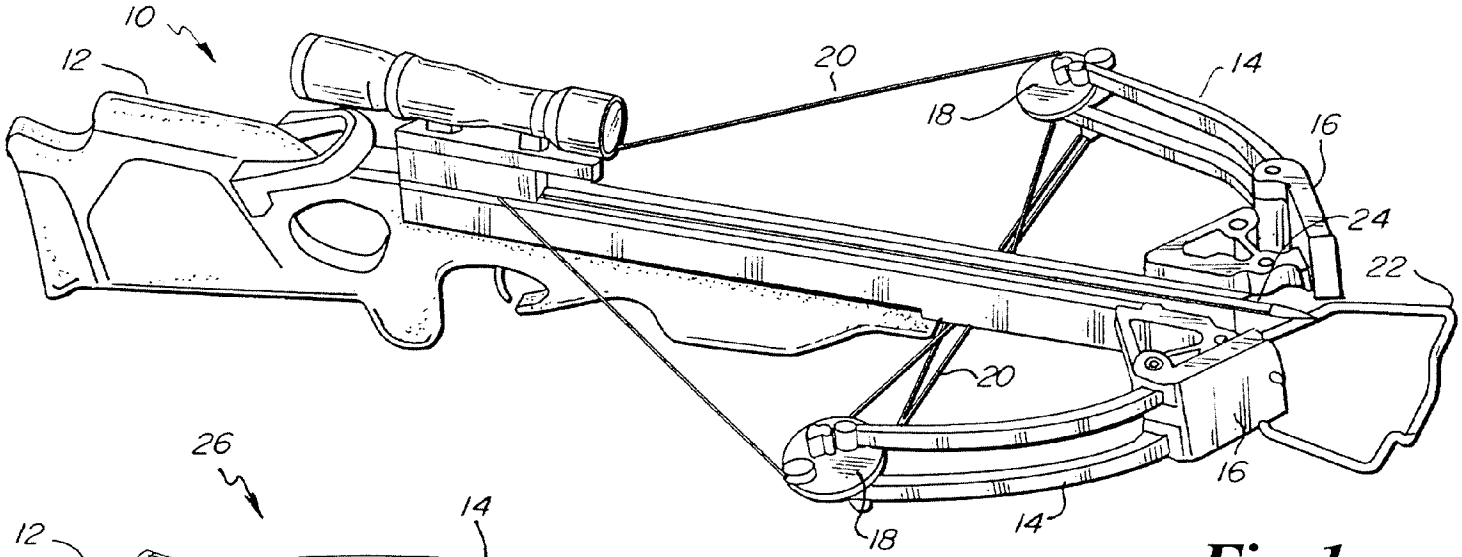
Fig. 1 (PRIOR ART)
FIG. 1 is a prior art view of a crossbow.
Figure 2:
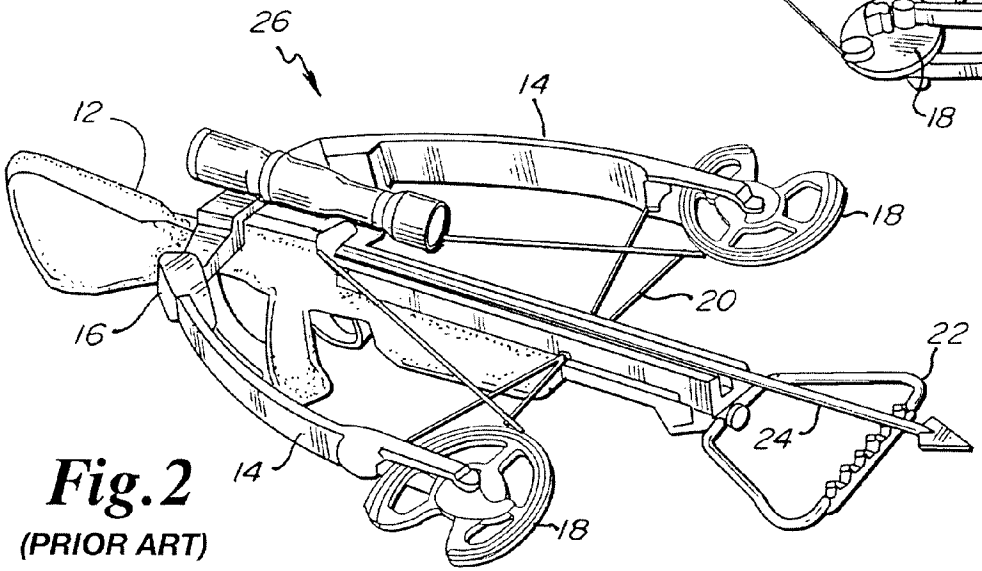
Fig. 2 (PRIOR ART)
FIG. 2 is a prior art view of a reverse limb crossbow.
Figures 3, 3A:
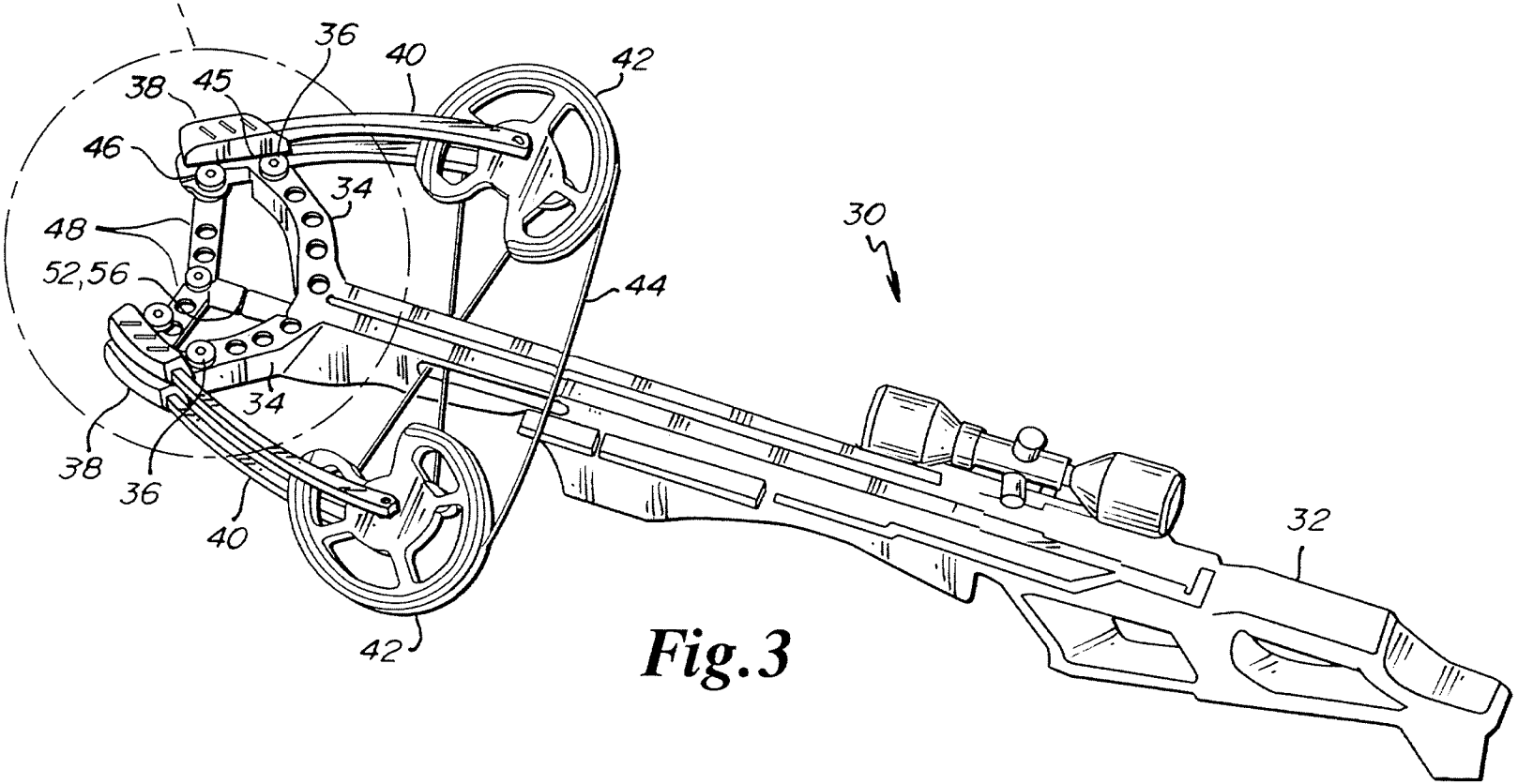
FIG. 3 is a top perspective view of the crossbow with rotating limb pockets of the present invention with the limb pockets rotated outwardly to a low poundage state showing a limp arrow string.
FIG. 3A is an enlarged view of the circled portion marked 3A of FIG. 3.
Figure 3A:
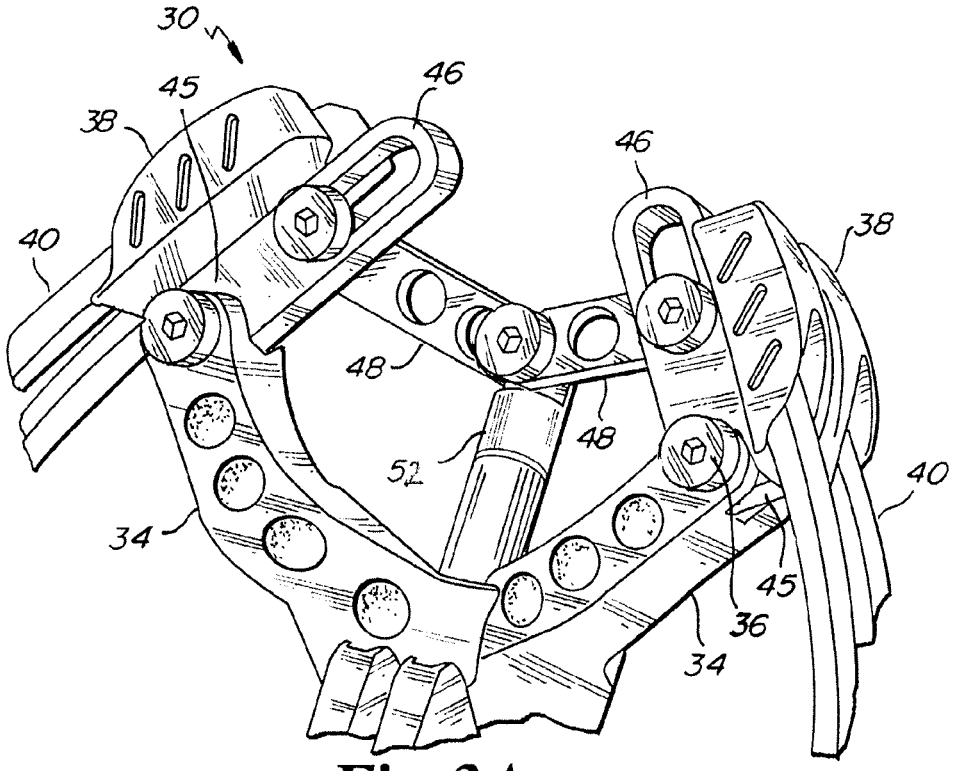
Figure 5:
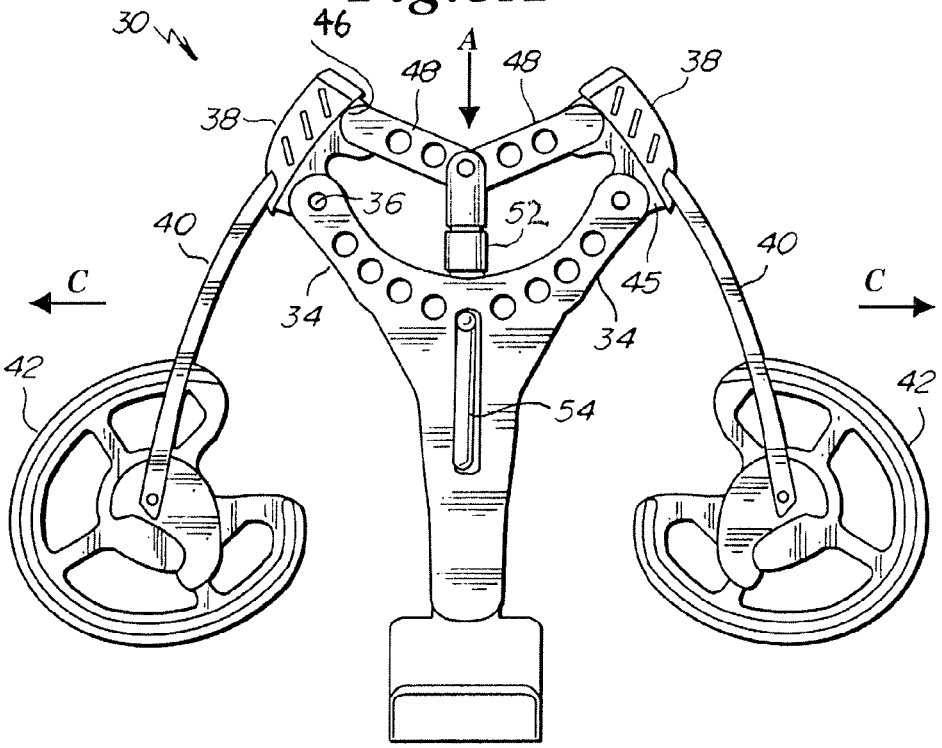
FIG. 5 is a top plan forward sectional view of the present crossbow with the limb pockets beginning to be rotated inwardly to a higher poundage state.
Figure 4:
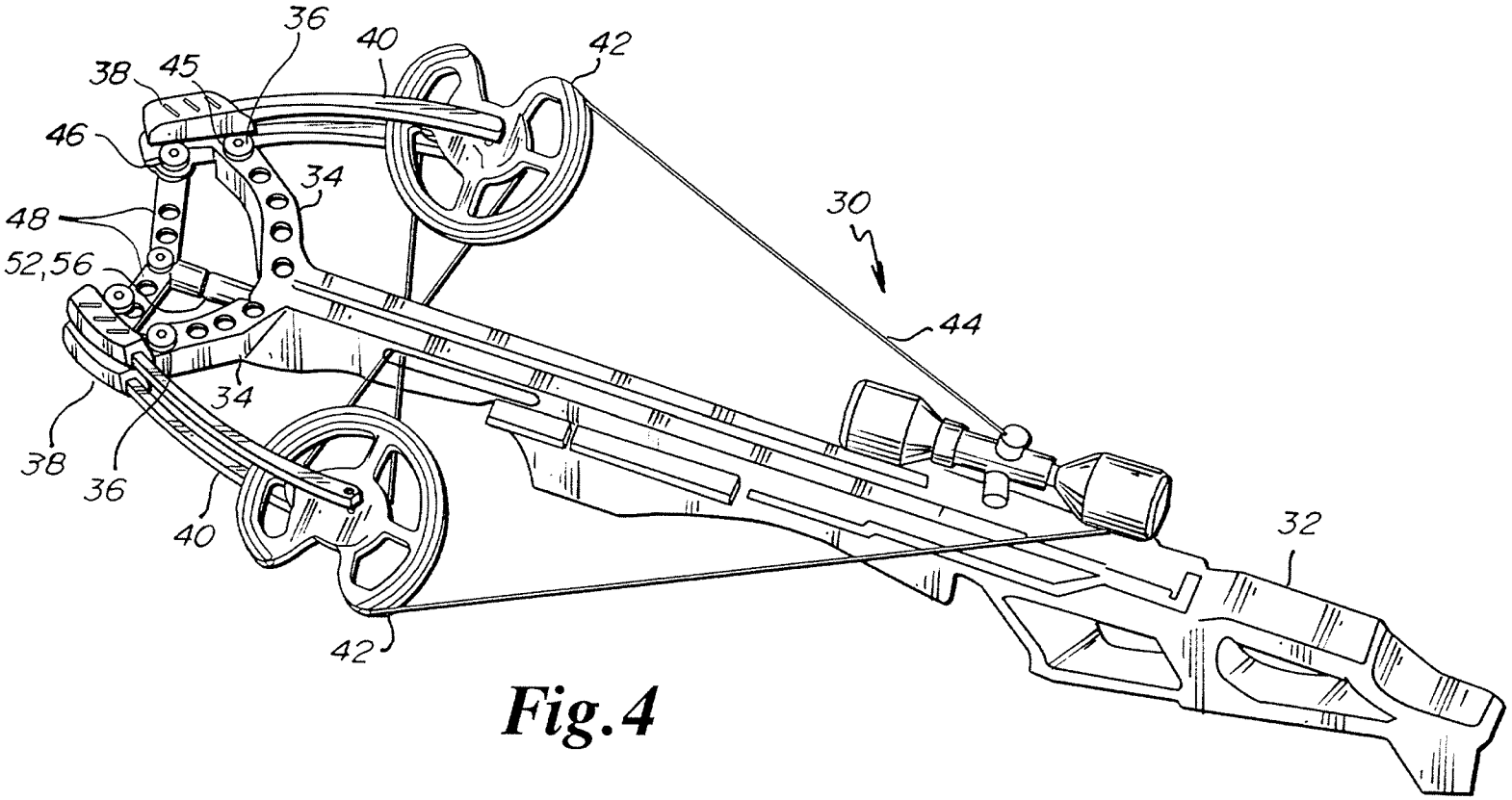
FIG. 4 is a top perspective view of the present crossbow with the limb pockets rotated outwardly to a low poundage state showing the arrow string hand cocked at low poundage.
Figure 6:
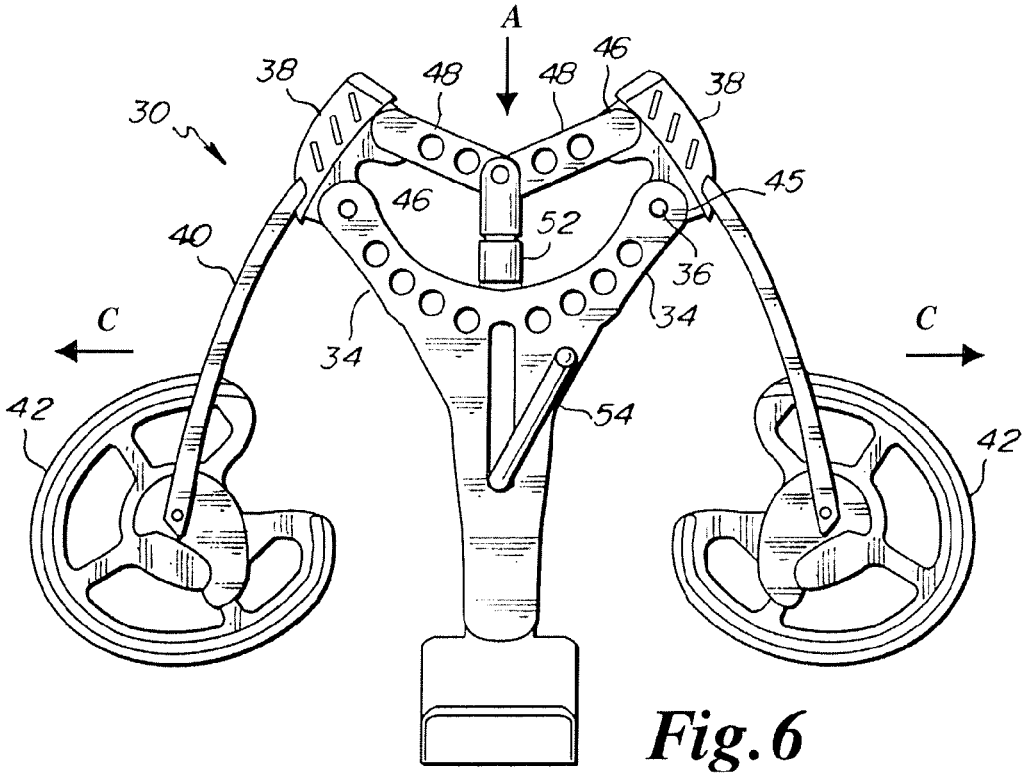
FIG. 6 is a top plan forward sectional view of the present crossbow with the limb pockets further being rotated inwardly to an even higher poundage condition.
Figure 7:
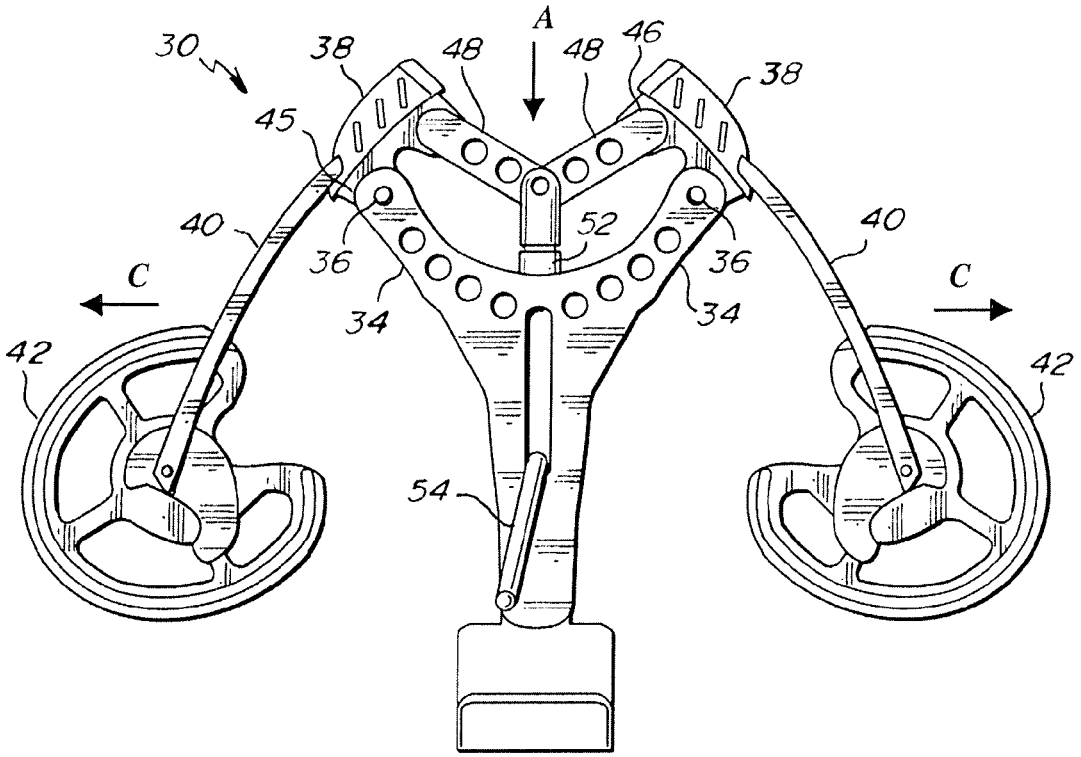
FIG. 7 is a top plan forward sectional view of the present crossbow with the limb pockets being rotated inwardly to an even higher poundage condition.
Figure 8:
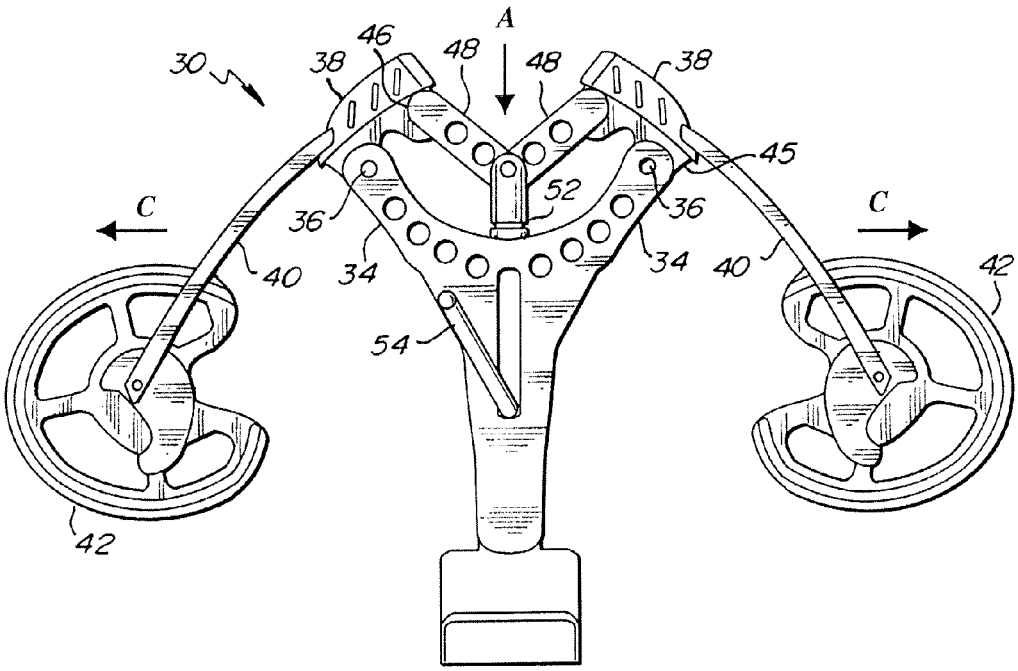
FIG. 8 is a top plan forward sectional view of the present crossbow with the limb pockets being rotated inwardly to an even higher poundage condition.
Figure 9:
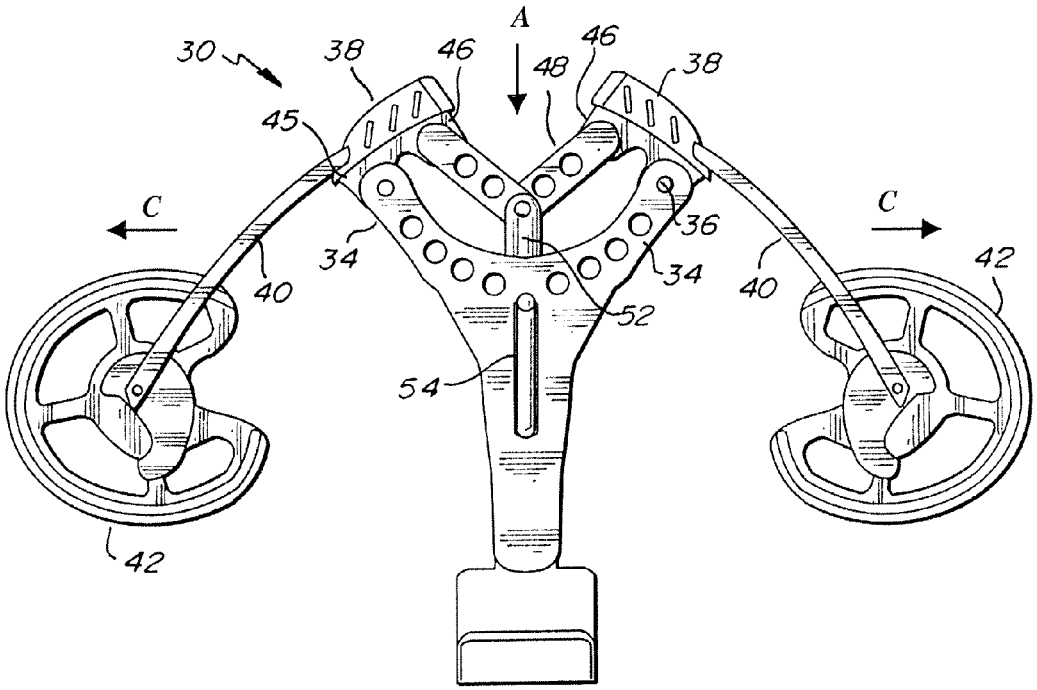
FIG. 9 is a top plan forward sectional view of the present crossbow with the limb pockets being rotated inwardly to its highest poundage condition.

Referring to FIGS. 3-4, the crossbow with rotating limb pockets 30 maybe understood. The crossbow 30 has a rifle-like frame 32 with forward, outward limb arch supports 34 which support pivot pins 36 at their distal ends. Rotating limb pockets 38 are pivotally and rearwardly secured to the arch support pivot pins 36 at rearward pocket pivots 45.

Figure 11:
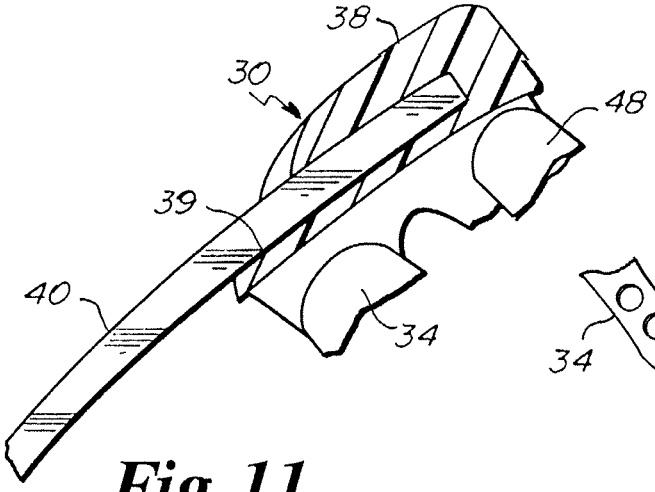
FIG. 11 is partially broken away view of one of the limb pockets showing its sloping floor radiused the same as the limb.
Figure 10:
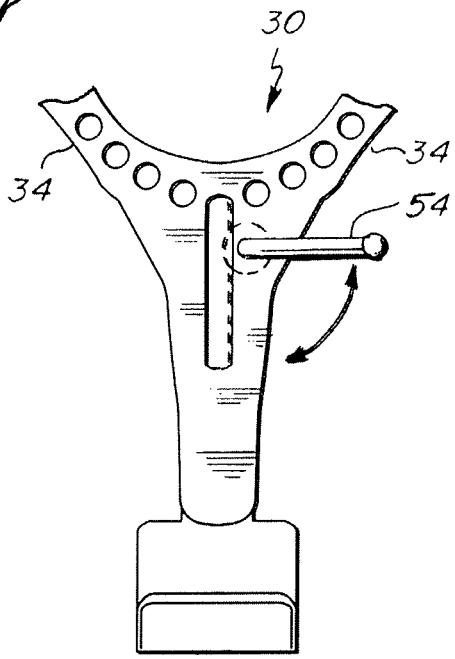
FIG. 10 is a top plan view of a typical rack and pinion jack.

Limbs 40 with distal cams 42 supporting cables and bow string 44 are suitably fixed to the limb pockets 38 such as by screws (not shown). The floor 39 of the limb pockets 38 are radiused (FIG. 11) similar to the limb 40 to give more support to limb 40 to prevent limb breakage just outside of the limb pocket 38. Forwardly the limb pockets 38 are pivotally secured to links 48 at forward pocket pivots 46. Links 48 are pivotally joined to forward and rearward moving actuator 52 and controlled by a crank mechanism 54, such a screw jack 56 (FIG. 10). A hydraulic pump with a ram, compressed gas cylinder with piston, rack and pinion or a winch may also work as actuator 52.

In FIGS. 3 and 3A, the actuator 52 is fully extended wherein the limb pockets 38 are outermost and the limb cams 42 inwardmost. The crossbow 30 in this condition is in a low poundage state for easy cocking of the string and loading a bolt or arrow all by hand (FIG. 4).

In FIGS. 4-9, retracting the actuator 52 with crank mechanism 54 or screw jack 56 (arrow A) rotates the limb pockets 38 inwardly (arrow B) and the limb cams 42 outwardly (arrow C) to a high poundage state ready for bolt 24 loading and shooting.

In reverse order of cranking, the crossbow 30 can be backed down from its high poundage state (FIG. 9) to its low poundage state (FIG. 4). Then the bow string 44 can be uncocked and the arrow or bolt 24 removed by hand.

The preceding specification and FIGS are for illustrative purposes only with the intended scope of the present invention to be understood by the following claims.

What is claimed:

1. A high poundage, compact, easy cocking crossbow, comprising:

a) a rifle-like frame with forward, outward. Y-shaped limb arch supports which support pivot pins at their distal ends;

b) rotating limb pockets with forward and rearward pocket pivots and a radiused pocket floor, the rearward pocket pivots are pivotally and rearwardly secured to the arch support pivot pins;

c) limbs with distal cams supporting cables and bow string are suitably fixed to the radiused floor of the limb pockets opposite the distal cams;

d) rigid links forwardly and pivotally secured to the forward pocket pivots of the limb pockets which are further pivotally joined together and to a forward and rearward linearly moving actuator, wherein linearly extending the actuator rotates the links outwardly past the rearward pocket pivots and the pivot pins on the distal ends of the arch supports, the limb pockets outwardly and the limb cams inwardly to a compact low poundage state for transportation and easy cocking of the string and loading a bolt or arrow* while linearly retracting the actuator rotates the links inwardly substantially past the pivot pins on the distal ends of the arch supports, the limb pockets inwardly and the limb cams outwardly to a high poundage state ready for shooting; and e) a crank mechanism linearly extending and retracting the actuator chosen from a group comprising a rack and pinion, a screw jack, a hydraulic winch or compressed air.

2. The crossbow of claim 1 wherein the limbs are fixed to the limb pockets by screws.

3. A high poundage, compact, easy cocking crossbow, comprising:

a) a rifle-like frame with forward, outward. Y-shaped limb arch supports which support pivot pins at their distal ends;

b) rotating limb pockets with forward and rearward pocket pivots and a radiused floor, the rotating limb pockets are pivotally and rearwardly secured to the arch support pivot pins at rearward pocket pivots;

c) limbs with distal cams supporting cables and bow string are suitably fixed to the radiused floor of the limb pockets opposite the distal cams;

d) rigid links forwardly and pivotally secured to the forward pocket pivots of the limb pockets which are further pivotally joined together and to a forward and rearward linearly moving actuator; and e) a crank mechanism linearly extending and retracting the actuator whereas linearly extending the actuator rotates the links outwardly past the rearward pocket pivots and the pivot pins on the distal ends of the arch supports, the limb pockets outwardly and the limb cams inwardly to a compact low poundage state for transportation and easy cocking of the string and loading a bolt or arrow, while linearly retracting the actuator rotates the links inwardly substantially past the pivot pins on the distal ends of the arch supports, the limb pockets inwardly and the limb cams outwardly to a high poundage state ready for shooting.

4. The crossbow of claim 3 wherein the limbs are fixed to the limb pockets by screws.

5. A high poundage, compact, easy cocking crossbow, comprising:

a) a rifle-like frame with forward, outward. Y-shaped limb arch supports which support pivot pins at their distal ends;

b) rotating limb pockets with forward and rearward pocket pivots and a radiused pocket floor, the rearward pocket pivots are pivotally and rearwardly secured to the arch support pivot pins;

c) limbs with distal cams supporting cables and bow string are suitably fixed to the radiused floor of the limb pockets opposite the distal cams;

d) rigid links forwardly and pivotally secured to the forward pocket pivots of the limb pockets which are further pivotally joined together and to a forward and rearward linearly moving actuator, wherein the limb pockets pivot inwardly and outwardly on the pivot pins of the limb arch supports and the links; and e) a crank mechanism controlling and linearly moving the actuator whereas linearly extending the actuator rotates the links outwardly past the rearward pocket pivots and the pivot pins on the distal ends of the arch supports, the limb pockets outwardly and the limb cams inwardly to a compact low poundage state for transportation and easy cocking of the string and loading a bolt or arrow, while linearly retracting the actuator rotates the links inwardly substantially past the pivot pins on the distal ends of the arch supports, the limb pockets inwardly and the limb cams outwardly to a high poundage state ready for shooting, the actuator chosen from a group comprising a rack and pinion, a screw jack, a hydraulic winch or compressed air.

6. A method of cocking a high poundage, compact, crossbow having a rifle-like frame with forward, outward, Y-shaped limb arch supports which support pivot pins at their distal ends; rotating limb pockets with forward and rearward pocket pivots, the rearward pocket pivots are pivotally secured to the arch support pivot pins; limbs with distal cams supporting cables and bow string are suitably fixed to the radiused floor of the limb pockets opposite the distal cams; links pivotally secured to the forward pocket pivots of the limb pockets which are pivotally joined together and to a forward and rearward linearly moving actuator, the method comprising:

a) linearly extending the crank mechanism rotating the links outwardly past the rearward pocket pivots and the pivot pins on the distal ends of the arch supports, the limb pockets outwardly and the limb cams inwardly to a compact low poundage state for transportation and easy cocking of the string and loading of a bolt or an arrow; and b) linearly retracting the actuator rotating the links inwardly substantially past the pivot pins of the distal ends of the arch supports, the limb pockets inwardly and the limb cams outwardly to a high poundage state ready for shooting.

* * * * *